United States Patent [19]

Lemerre

[11] Patent Number: 4,616,452

[45] Date of Patent: Oct. 14, 1986

[54] PREFABRICATED CONSTRUCTIONS AND THEIR COMPONENTS

[76] Inventor: Guy Lemerre, 10 Rue Sadi-Carnot, 14000 Caen, France

[21] Appl. No.: 617,811

[22] Filed: Jun. 6, 1984

[30] Foreign Application Priority Data

Jun. 6, 1983 [FR] France ..... 83 09353
Jan. 27, 1984 [FR] France ..... 84 01323

[51] Int. Cl.[4] ..... E04B 7/00

[52] U.S. Cl. ..... 52/71; 52/90; 52/94; 52/303

[58] Field of Search ..... 52/262, 642, 92, 90, 52/91, 93, 639, 640, 68, 69, 71, 94, 303, 73; 403/295, 340

[56] References Cited

U.S. PATENT DOCUMENTS

| | | | |
|---|---|---|---|
| 573,452 | 12/1896 | Delahunt | 52/92 |
| 2,409,383 | 10/1946 | Pedersen | 52/90 |
| 2,482,918 | 9/1949 | Kump | 52/79.9 |
| 2,648,877 | 8/1953 | Vermilya | 52/92 |
| 2,896,273 | 7/1959 | Petter | 52/90 |
| 3,184,012 | 5/1965 | Fujishma | 52/90 |
| 3,346,999 | 10/1967 | Johnson | 52/642 |
| 3,748,803 | 7/1973 | Widerby | 52/199 |
| 4,228,729 | 10/1980 | Messick | 52/199 |

FOREIGN PATENT DOCUMENTS

| | | | |
|---|---|---|---|
| 1169657 | 1/1959 | France | 52/262 |
| 1296912 | 5/1962 | France | 52/90 |
| 1379991 | 10/1964 | France | 52/92 |
| 1453984 | 8/1966 | France | 52/90 |

*Primary Examiner*—John E. Murtagh
*Attorney, Agent, or Firm*—Larson & Taylor

[57] ABSTRACT

A prefabricated constructional component formed by a flat self supporting panel bent in a V shape and adapted to form a vertical section of the assembly formed by an outer wall of the construction and by the roof pane extending this wall upwardly is characterized in that it is in the form of a wooden chassis (37) with closed contour defining two flat panes connected together in a V shape, this frame being defined laterally by bonded laminate beams (38) bent into a V shape whose opened out length is greater than 5 meters, and each pane being closed by two flat parallel facings (43) of which at least the one disposed on the outside is formed from plywood.

14 Claims, 12 Drawing Figures

Figure 6:
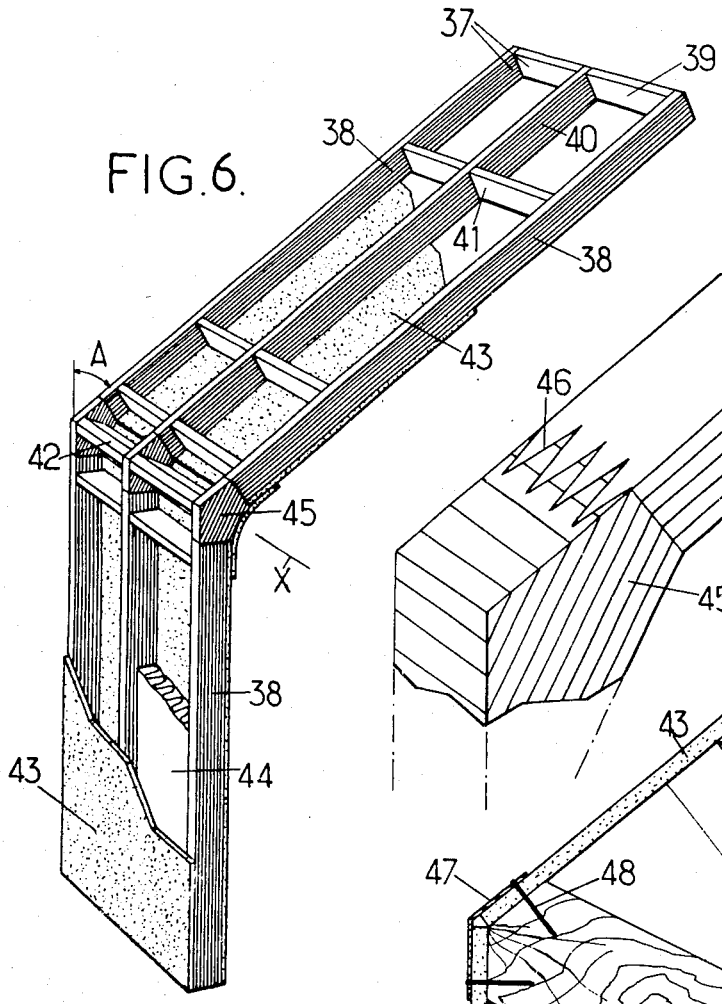

Fig.1.
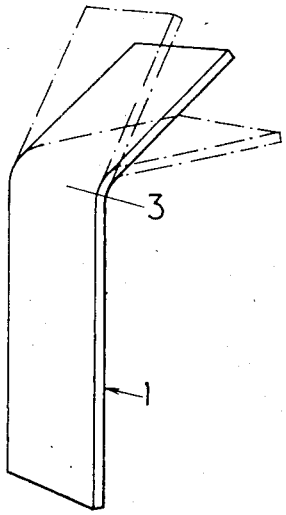
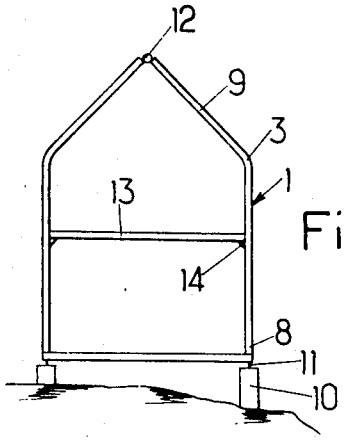
Fig.2.
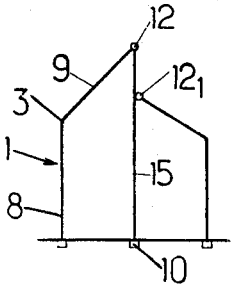
Fig.3.
Fig.4.
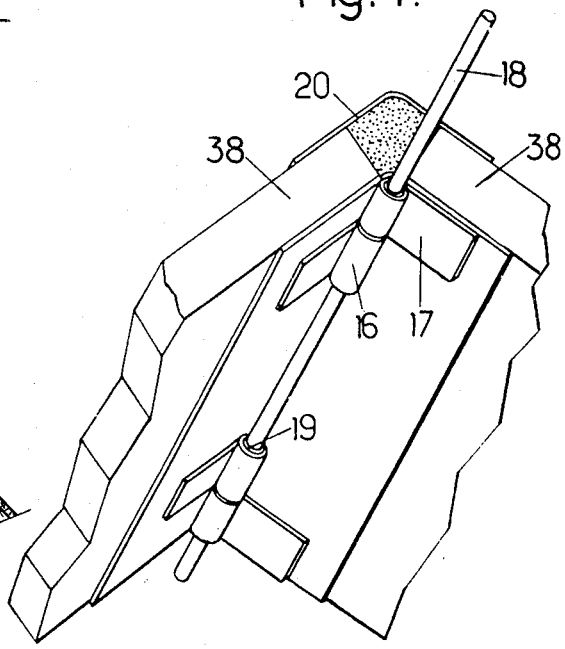
Fig.5.
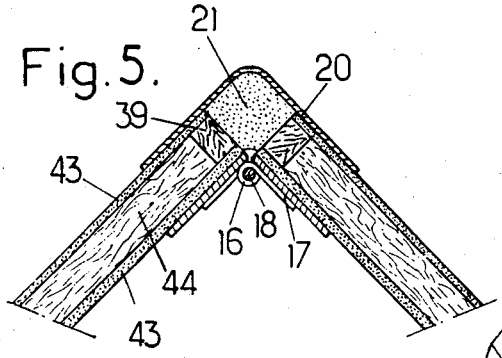

FIG.9.
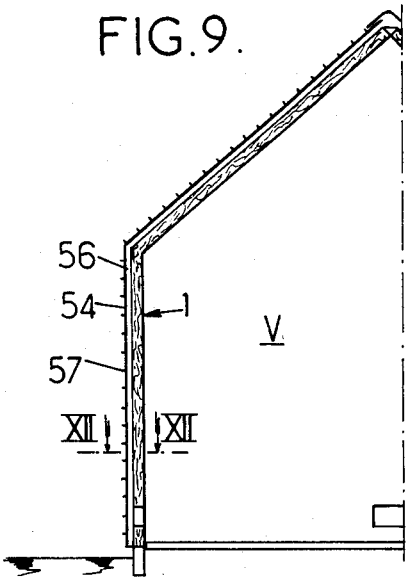
FIG.10.
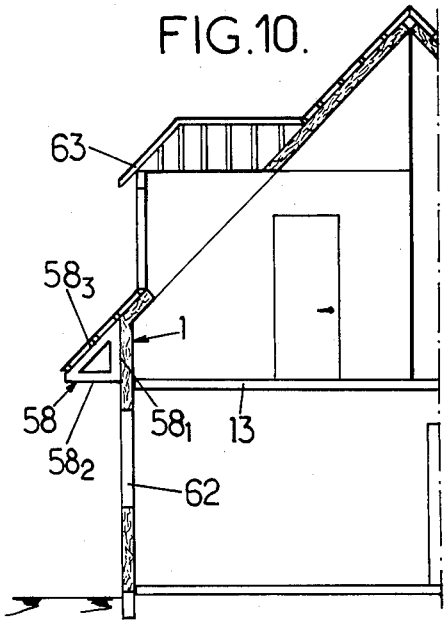
FIG.12.
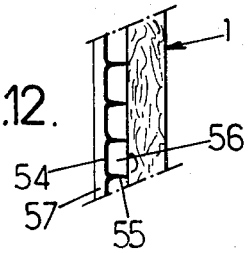
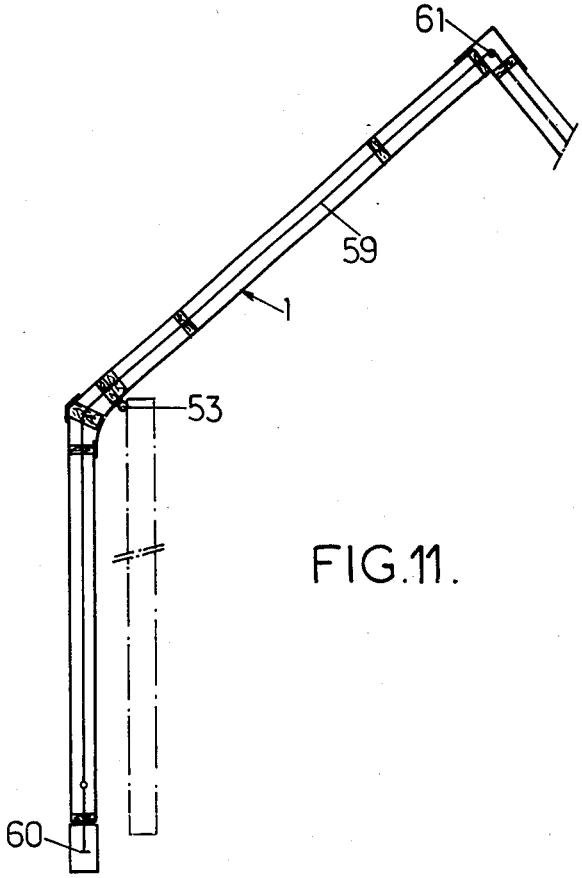
FIG.11.

PREFABRICATED CONSTRUCTIONS AND THEIR COMPONENTS

The invention relates to constructions of the individual house, clinic, school kind . . . generally with one or two levels, having flat inclined roofs and formed by prefabrication, that is to say whose external walls are formed from factory manufactured components, each of these elements extending at least over the whole height of a room.

It also relates to said prefabricated components.

It has already been proposed to form prefabricated construction components from flat bent self-supporting panels containing a heat insulating material and each adapted to form a vertical section of the assembly formed by an external wall construction and by the roof pane extending this wall upwardly, each panel once erected bearing by its upper edge against a similar panel erected opposite thereto so as to form an arch.

But with these panels, defined by two bent parallel and unframed sheets of plastic material, at best glass houses of low height with a rounded contour could be erected.

The invention makes it possible to provide particularly economical constructions of relatively great height of the above mentioned kind by means of a very small number of prefabricated panels of great height essentially with a wood base, which panels are both especially light and strong and so easy to transport despite their large dimensions.

For this, the prefabricated components of the invention, formed by flat bent self-supporting panels containing a heat insulating material and each adapted to form a vertical section of the assembly formed by an external wall of the construction and by the roof pane extending this wall upwardly, are essentially characterized in accordance with the invention in that they are in the form of a wooden frame with closed contour defining two flat panes joined together in the form of a V, this frame being defined laterally by two beams made at least partly of bonded laminate wood and bent in the shape of a V whose opened out length is greater than 5 meters and each pane being closed by two flat parallêl facings at least that one of which, which is disposed outside, is formed from ply-wood.

In preferred embodiments, recourse is further had to one and/or the other of the following arrangements:

the opened out length of each lateral beam bent in the shape of a V reaches or even exceeds 10 meters, each of the two bent beams which laterally define the wooden frame is formed by two straight stringers made from wood assembled together by pinning and sticking to an intermediate key itself made from bonded laminate, the two lateral bent beams according to the preceding paragraph are interlocked together by horizontal cross pieces made from solid wood one of which connects together the two keys comprised by these beams.

in a component according to the preceding paragraph, the continuity of the internal face of the bending zone is obtained by means of a bent plywood sheet fixed to the lower edge of the upper internal facing, to the upper edge of the lower internal facing and to the cross piece connecting the two keys together, in a component according to at least the paragraph which precedes the preceding one, the continuity of the external face of the bending zone is obtained by means of a metal sheet bent into a V shape and fixed to the cross piece connecting together the two keys as well as to the lower edge of the upper external facing and to the upper edge of the lower external facing, a component is adapted so as to support a part of the floor of a storey, the component is formed with openings equipped with windows or similar, the outer face of the V bent panel is covered with a metal sheet held parallel to this surface, at a small distance therefrom, by spaces, preferably integral with said metal sheet, which define channels extending over the whole height of the panel, which channels may be used for the purpose of ventilating and/or air conditioning the inner volume of the construction, the outer face of the metal sheet according to the preceding paragraph is provided with fastening means for roofing elements, there is added externally to the upper portion of the vertical pane of the panel a hollow beam forming a projecting roof part, having a triangular cross section and being defined by a vertical face applied against said portion, a horizontal lower face and a slanting face extending the outer face of the slanting pane of the panel downwards, the V bent panel comprises a hinge in the vicinity of its bend for folding the two panes of the V one against the other so as to facilitate transport without for all that adversely affecting the continuity of the opened out and erected panel, the continuity of the opened out and erected panel is reinforced by at least one cable stretched between two anchorage points situated respectively in the foundation of the vertical pane and at the summit of the slanting pane, in a construction comprising two V shaped prefabricated panels of the above defined kind, erected one against the other so as to bear one against the other, directly or not, this bearing is provided at the level of at least one hinge means with horizontal axis, formed preferably in the manner of a hinge formed from a common bar and sockets extended by plates fixed respectively to the two panels.

The invention comprises, apart from these main arrangements, certain other arrangements which are used preferably at the same time and which will be more explicitly discussed hereafter.

In what follows, preferred embodiments of the invention will be described with reference to the accompanying drawings in a way which is of course in no wise limiting.

Figure 7:
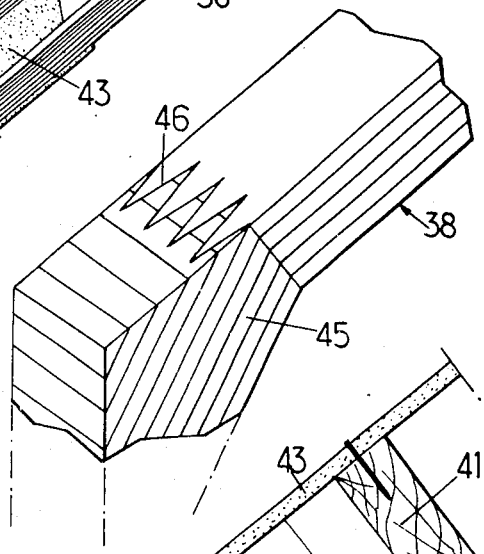
Figure 8:
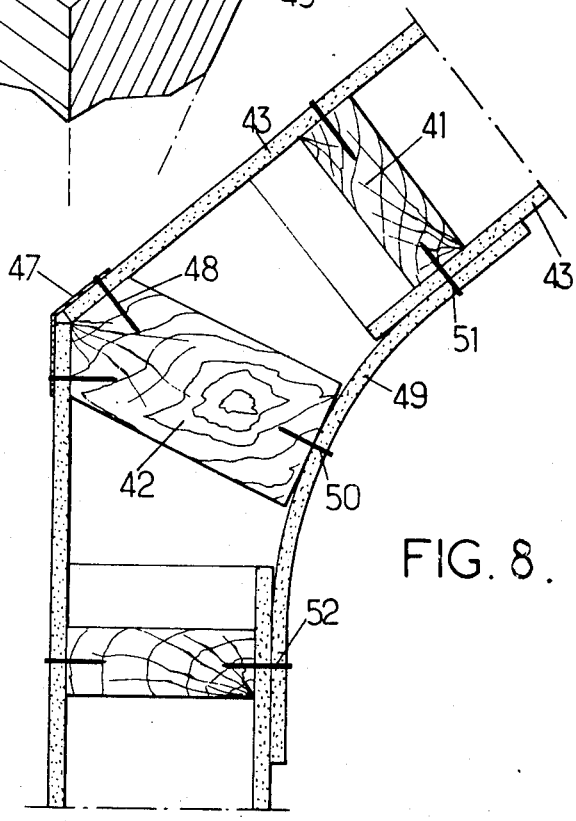

FIG. 1 of these drawings shows a perspective view of a flat panel bent into a V shape in accordance with the invention, FIGS. 2 and 3 show schematically in vertical cross sections two constructions formed from such V bent panels according to the invention, FIG. 4 shows a bottom perspective view of an upper hinge used in such a construction, FIG. 5 is a vertical cross sectional view of the roof ridge of a construction of the above type, FIG. 6 shows a perspective view, in greater detail than FIG. 1, with parts cut away, of a panel constructed in accordance with the invention, FIG. 7 shows an enlarged perspective view of a detail of this panel, FIG. 8 shows, also on a large scale, the bending zone of this panel, in a vertical section perpendicular to the bending line, FIGS. 9, 10 and 11 show schematically in partial vertical cross sections three constructional variants formed in accordance with the invention, and FIG. 12 is a partial horizontal section of FIG. 9 through XII—XII.

Each panel, called "shell" hereafter, is factory prefabricated and has the general shape of an elongate rectangle, bent in a V shape, the bending line of the V extending along the width of this rectangle.

The width of the rectangle is less than or equal to 2.5 meters so as to allow it to be transported by road, this width being more especially equal to 30,120 or 180 cm.

Its length is relatively great, being greater than 5 meters and possibly reaching or even exceeding 10 meters.

The thickness of the shells considered is generally between 8 and 25 cm.

Each shell 1 is bent into a V through a sharp angle with a small radius of curvature as shown at 3 in FIGS. 1 to 3, which defines two flat panes 8 and 9 on each side of this bend 3, the lower vertical one 8 being intended to form a wall and the other oblique upper one 9 being intended to form a flat roof pane.

The angle of the bend may be chosen in a wide range going from 30° to 90°.

Since each construction uses a plurality of similarly bent shells intended to be assembled side by side so as to form one of the frontage faces of the construction, on which is mounted the associated roof pane, these similar shells may be easily stacked on each other for transporting, the stacks thus obtained then requiring only a very small space.

So as to further reduce the space required during transport, it may be advantageous to provide a hinge means in the vicinity of the bend of each shell so as to make it possible to fold back the two panes of this shell one against the other: such a hinging means, a materialized by a hinge situated at the level of the internal face of the V has been shown at 53 in FIG. 11. This hinge 53 is of course completed by appropriate means for locking the shell in its opened out condition during positioning thereof with a view to forming a construction.

The shells are equipped during manufacture with most of the fittings which they must comprise so as to play their final role as wall and roof part in the finished construction, fittings such as frames, preferably made from wood, defining openings and equipped with windows 62 (FIG. 10), which may be opened or not, dormer windows or gable windows 63, or double dead lights with intermediate blinds, door frames, electric installations, sanitary water and possibly heating pipes, support plates 14 for intermediate floors 13 . . .

Each shell is in the general form of a wooden frame 37 (FIG. 6) defined laterally by two beams or ribs 38 bent into a V and at the top and bottom by horizontal cross pieces 39.

This frame 37 is completed and reinforced:

by an intermediate beam or rib 40 parallel to the lateral ribs 38 and similar thereto, but preferably a little thinner in the direction X of the bending line of the shell, and by several horizontal spacers 41, 42 connecting the three ribs 38 and 40 together: that one of these spacers designated by the reference 42 and situated at the level of line X is stouter than the others and will be discussed in greater detail hereafter.

Frame 37 is closed by parallel flat facing plates 43.

Each outer plate 43 is formed from a weather resisting plywood and each inner plate 43 is preferably formed also by plywood, but could also be made from any other appropriate material such as chip board, plastic material reinforced with glass fibers or similar, resin impregnated fabric, metal, cardboard, plaster . . .

These plates 43 may be treated at least on the surface and/or coated with any desirable protecting or covering coating (paint, varnish, plaster . . . ).

Said plates 43 are sticked and stapled to the ribs and possibly to the cross pieces so as to form one with the frame and contribute to the holding and strength of the shell.

The inner volume of frame 37 is filled, at least partially, with padding 44 having good heat insulation and possibly sound proofing qualities, this padding being for example formed from flexible or semi rigid felt or plastic foam.

A narrow air space may be provided between this padding 44 and one of the facings 43.

Padding 44 may be interrupted, as well as the corresponding facing portions 43, over a certain height of the shell, more especially in its upper zone, for lighting and possibly ventilation purposes, which confer on the zone concerned the appearance of a pergola. The volume thus freed may be occupied by glazing, offset upwardly if need be if it is a question of a zone slanting with respect to the vertical.

Each rib 38, 40 is formed by two straight stringers made from solid or bonded laminate wood joined together by a key 45 made from a bonded laminate wood.

The assembly of each stringer with the key 45 is provided by sticking and pinning, that is to say by mutual imbrication of complementary teeth 46 cut out from the mutual facing edges of the strips forming these two elements.

These teeth 46 have advantageously the shape of pointed triangular saw teeth as shown in FIG. 7.

When the shell is in its erected operational position illustrated in FIG. 6, the mean plane of each strip forming each lower stringer is vertical and the mean plane of each strip forming each key 45 is inclined with respect to the vertical through an angle which is equal to a half of angle A through which the mean plane of each strip forming each upper stringer is slanted with respect to the vertical.

The horizontal cross pieces 39, 41 and 42 are formed by solid wooden pieces.

That one 42 of these cross pieces situated at the level of the bending line X of the shell connects the different keys 45 together.

In the case illustrated in which the shell comprises an intermediate rib 40, said cross piece 42 is formed from two half cross pieces disposed one in the extension of the other and each extending horizontally between the central key comprised by said intermediate rib 40 and the key comprised by a lateral rib 38 and each half cross piece is fixed to the two corresponding keys by nailing and/or by sticking.

It is advantageous to give to the outer surfaces of the keys 45 and half cross pieces 42 identical shapes disposed horizontally in the extension of each other so as to facilitate supporting external facings.

This form may be the curved one of a tile or a portion of a cylinder of revolution.

In the embodiment shown, said form is that of a truss or a dihedron with horizontal line of intersection whose angle of the apex is supplementary of angle A.

In this case, the external covering of the shell may be provided by two completely flat facings each extending as far as the horizontal intersecting line of the truss, the mutual juxtaposition of these facings being made along this intersecting line.

To complete the continuity of this covering and to reinforce the shell while ensuring a good transfer of the forces from one of the external facings to the other, the zone of juxtaposition of these facings may be advantageously covered with a metal sheet 47 (FIG. 8), more especially made from aluminium, bent in a V shape whose opening is equal to that of the truss, the two flanges of this metal sheet being fixed respectively to the two flat areas of the truss by nailing or stapling at 48 with interpositioning of the juxtaposed edges of the two facings in question.

The upper edge of metal sheet 47 is preferably formed so as to avoid any penetration of rain water between it and the facing which it covers, being possibly associated for this purpose with an appropriate seal or bead.

The shell may also be closed internally by means of two flat facings each interrupted at the level of keys 45 (see FIG. 6), that is to say at a small distance from cross piece 42 as shown in FIG. 8.

The continuity and taking up of the stresses are here obtained by a piece of plywood 49 bent in the form of a cylindrical tile and fixed by sticking and stapling, on the one hand at its center at 50 to the lateral facing face of cross piece 42 and on the other hand at the top at 51 to the lower edge of the upper facing and at the bottom to the upper edge of the lower facing.

Each of these latter two attachments is preferably effected on the side of one of the above cross spacers 41.

The assembly obtained in the way described above forming the shell bent in a V shape is very strong and the upper oblique pane may have a large horizontal space, which is surprising for a wooden structure.

It should further be noted that this result is obtained by using economical materials, essentially wood based.

To form a construction by means of the V shaped shells described above, at least two of these shells are erected so that they each have a vertical base 8, so that the two bases are parallel and so that the upper oblique panes 9 of the two panels are turned towards each other and bear against each other (FIGS. 2 and 3).

Furthermore, each base 8 is mounted on a foundation block 10, preferably through a flexible support 11 forming a semi-hinge and the upper panes 9 bear advantageously mutually one against the other at the level of a hinge portion 12 with horizontal axis H.

The triangulated assembly thus obtained, which forms a sort of "arch", may be subjected to slight deformations when it is subjected to external stresses of high intensity such as those due to a strong wind or storm or else to an earthquake: said assembly is able to resist such forces without excessive local stresses likely to cause damage or breaks.

The assembly method discussed is particularly advantageous in the use of the very light V shaped shells described above: the overall strength of the edifice may in fact be appreciably increased to the point of making it comparable to that of an edifice of the same dimensions constructed with much heavier conventional materials, namely generally at least five times heavier and much more expensive.

The thickness of the triangulated "arches" defined is multiplied by juxtaposing laterally against the shells forming these arches other similar shells, which forms vaulted works formed of several juxtaposed arches.

These works are closed at both ends by transverse gable ends.

The mutual lateral assembly of the different panels forming frontages and gable ends are sealed against rain water and preferably against heat and sounds.

The forms which the works in question may assume are extremely varied.

One of them, shown in FIG. 2, is that of a conventional house with vertical walls over which is placed a double pitch roof.

In this construction, an intermediate floor 13 is provided, supported by brackets 14 provided ready in shells 1 so as to form a storey.

In a variant shown schematically in FIG. 3, the two constituent shells bent in a V shape have unequal heights and bear one against the other at the level of two hinges 12 and 12' which are both supported by a central wall 15 extending parallel to the bases 8 of these two panels.

Works comprising roofs of the "shed" type may be contemplated formed:

at both ends by shells of the kind described above, and, between these ends, from slanting panes corresponding to the upper sections of such shells and resting at their bases on semi hinges themselves placed at the top of posts internal to said works.

One embodiment of an upper hinge has been illustrated in FIGS. 4 and 5.

It is in the form of a hinge comprising:

a plurality of metal sockets 16 extended outwardly by plates 17 firmly secured to the shells to be assembled together, and a bar 18 passing through these sockets or more precisely bushes 19 made from a plastic material forming bearings force fitted into said sockets.

The respective numbers and positions of these sockets and plates are chosen so that, after bar 18 has been positioned in these sockets, the respective positions of the two shells hinged together are strictly defined in the direction of the hinge axis H: it is more especially sufficient for this to provide two pairs of juxtaposable sockets for each hinge, the two sockets the closest together being connected to a panel and the two sockets the furthest away from each other to the other panel.

Each hinge is covered by a cover plate or capping 20 formed more especially by a metal sheet bent in the form of an upturned V, with interpositioning of a filling mass 21 for completing the sealing and the heat insulation of the roof, this mass being formed for example by glass wool.

During manufacture of the above shells 1 bent into the shape of a V, a metal sheet 54 (FIGS. 9 and 12) may be added to the outer face of these shells and held parallel to this face by spacers 55 adapted so as to define an assembly of parallel channels 56 extending over the whole height of the shell.

The spacers 55 may be longitudinal ribs integral with the metal sheet 54.

The channels 56 in question, whose upper or lower end is communicated with the volume V of the finished construction, may be used in any desirable way for guiding the flow, natural or forced, of a downward or upward air current for ventilating and/or air conditioning the volume V.

The outer surface of metal sheet 54 may be provided with means for attaching roofing or covering elements such as tiles, frontage panels . . . , means such as lugs 57 integral with said metal sheet.

So as to cause the slanting roof of a construction of the above kind to project horizontally from the vertical wall which this roof extends upwardly, a hollow beam 58 (FIG. 10) forming a weather board and having a triangular section may be fixed externally to the upper portion of this wall, said beam being defined by, a vertical face $58_1$ applied against said upper portion, a horizontal lower face $58_2$, an upper slanting face $58_3$ extending exactly the upper face of the slanting roof.

So as to provide an extremely strong assembly between the upper slanting pane of each shell and its lower vertical pane, and thus to make it impossible for the roof of the construction comprising such a shell to be torn away under any circumstances, it is advantageous to provide at least one cable 59 (FIG. 11) made from steel tensioned inside said shell between a lower anchorage point 60 located in the foundation and an anchorage point 61 situated at the top of the shell, more especially at the level where this shell is hinged to the facing shell.

Purely by way of illustration and which is in no wise limiting, some indications are given hereafter concerning the method of constructing a shell such as shown in FIG. 6 which has given every satisfaction:

total thickness of the shell: of the order of 17 cm width of the shell of direction X: 1.2 m slant angle A with respect to the vertical of the oblique plane: 60°, height of the lower vertical plane: 2.5 m, length of the upper oblique pane: 3.5 m, thickness of each lateral rib 38 in direction X: 4 cm, thickness of the central rib 40 in direction X: 6 cm, width of the internal face of each key 45: 22 cm, height of the teeth 46 of the pinning portions: 3 cm and pitch between these teeth: 1 cm.

Following which and whatever the embodiment adopted shells bent in a V shape and constructions formed from such shells are finally obtained whose construction and assembly follow sufficiently from what has gone before.

These shells and constructions present numerous advantages with respect to those known heretofore and in particular the following ones:

the extreme lightness, the linear weight of the wood based frontage wall—roof assembly being several times less than the corresponding linear weight of heavy prefabrications solutions, the simplicity of the on site assembly because more especially it is unnecessary to provide special sealed connections between the upper edges of the walls and the lower edges of the adjacent roof panes, these walls and panes being formed by one piece parts, the possibility of prefabricating these one piece parts in the factory, the extremely low cost price which follows more especially from the preceding advantages, the great lightness resulting in particular in a number of corresponding reductions such as that of the volume of the materials used, that of the transport costs, that of the strength of the foundations . . .

the excellent resistance of the construction to external forces (winds, earthquakes . . . ) because of its slight deformability without breaking, the universality of the shapes likely to be created for constructions obtained from a very small number of modular starting elements or components, the marked originality of some of these shapes (in particular it is easy to provide lighting lamps or chimneys at the edge of the proposed constructions, with of course local interruptions of the upper hinges ), the possibility on the other hand of giving to other constructions, shapes which are quite conventional and perfectly adapted to local styles.

As is evident, and as it follows moreover from what has gone before, the invention is in no wise limited to those of its modes of application and embodiments which have been more especially considered; it embraces, on the contrary, all variations thereof.

I claim:

1. A prefabricated constructional component for an assembly formed by a flat bent self-supporting panel containing a heat insulating material and adapted to form a vertical section of the assembly, said panel forming an outer wall pane of the assembly and a roof pane extending from this wall pane upwardly;

characterized in that said panel is in the form of a wooden frame (37) having a closed contour defining said two flat panes (8,9) which are joined together in a V shape, this wooden frame being defined laterally by two opposed beams made at least partly of bonded laminated wood (38) and bent in a V shape, said beams having an opened out length greater than 5 meters, and each pane of said wooden frame being closed by two flat parallel facings (43) of which at least one is formed from plywood, and further characterized in that each of the two bent beams (38) which laterally define the wooden frame is formed by an intermediate key made from bonded laminate wood and two straight wood stringers with the bonded laminate wood having laminations inclined with respect to a vertical mean plane of said outer wall pane at an angle equal to one half of an inclination angle of a mean plane of said roof pane, said intermediate key being located between said wood stringers and having a pair of opposed toothed surfaces, and said wood stringers each having a toothed end surface which is assembled to a respective one of said opposed toothed surfaces of said intermediate key by imbricating and sticking to form said bent beam.

2. The component as claimed in claim 1, characterized in that the two lateral bent beams (38) are firmly secured together by horizontal cross pieces made from solid wood (39, 41, 42) one of which (42) connects together the two keys (45) comprised by these beams.

3. The component according to claim 2, characterized in that the continuity of an internal face of a bending zone is obtained by means of a bent plywood sheet (49) fixed to a lower edge of an upper internal facing (43), to an upper edge of a lower internal facing (43) and to the cross piece (42) connecting the two keys together.

4. The component according to claim 2, characterized in that the continuity of an external face of its bending zone is obtained by means of a metal sheet bent in a V shape (47) fixed to the cross piece (42) joining the two keys together as well as to a lower edge of an upper external facing and to an upper edge of a lower external facing.

5. The component according to claim 1, characterized in that the component includes a support means for supporting a part of a floor (13) of a storey.

6. The component according to claim 1 characterized in that the component is formed with openings equipped with windows (62, 63).

7. The component accordings to claim 1, characterized in that an external surface is covered with a metal sheet (54) held parallel to this surface, at a small distance therefrom, by spacers (55) preferably integral with said metal sheet, which define channels (56) extending over the whole height of the component, which channels can be used for ventilating and/or air conditioning the inner volume of the assembly.

8. The component according to claim 7, characterized in that an outer face of the metal sheet (54) is provided with fastening means (57) for covering elements.

9. The component according to claim 1, characterized in that there is added externally to an upper portion of the pane of this component a hollow beam (58) forming a weatherboard, having a triangular cross section and defined by a vertical face ($58_1$) applied against said portion, by a lower horizontal face ($58_2$) and by a slanting face ($58_3$) extending an outward face of the roof pane of the component downwardly.

10. The component according to claim 1, characterized in that the component comprises a hinge (53) in the vicinity of the panel bend for folding the two panes of the V one against the other so as to facilitate transport thereof.

11. The component according to claim 1, characterized in that the continuity of the opened out and erected panel is reinforced by at least one cable (59) stretched between two anchorage points (60, 61) situated respectively in a foundation of the vertical pane and at the top of the slanting pane.

12. The construction comprising two V shaped prefabricated panels according to claim 1, erected opposite each other so as to bear one against the other, directly or not, characterized in that their bearing is provided at the level of at least one hinging means (12) with horizontal axis, formed preferably in the manner of a hinge formed from a common bar (18) and sockets (16) extended by plates (17) fixed respectively to the two panels.

13. The component according to claim 1, characterized in that said wood stringers are made of bonded laminate wood, the laminations of the stringer forming part of said outer wall pane being parallel with the mean plane of said outer wall pane and the laminations of the stringer forming part of said roof pane which is angled with respect to vertical being parallel with the mean plane of said roof pane.

14. The component according to claim 1, characterized in that said wood stringers are made from solid wood.

* * * * *